US007149150B1

(12) United States Patent
Scarzello et al.

(10) Patent No.: US 7,149,150 B1
(45) Date of Patent: Dec. 12, 2006

(54) UNDERWATER SURVEILLANCE SYSTEM

(75) Inventors: John F. Scarzello, Columbia, MD (US); John J. Holmes, Columbia, MD (US); Edward C. O'Keefe, Columbia, MD (US); Robert A. Wingo, Manassas, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/151,182

(22) Filed: May 26, 2005

(51) Int. Cl.
*G02B 6/00* (2006.01)

(52) U.S. Cl. ..... 367/149; 367/131

(58) Field of Classification Search ..... 367/3, 367/4, 5, 149, 131; 385/12, 13; 250/227.16
See application file for complete search history.

(56) References Cited

U.S. PATENT DOCUMENTS 5,224,074 A * 6/1993 Sullivan ..... 367/3
6,765,487 B1 7/2004 Holmes et al.

* cited by examiner

*Primary Examiner*—Dan Pihulic
(74) *Attorney, Agent, or Firm*—Jacob Shuster

(57) ABSTRACT

A plurality of sensing modules are deployed by positioning thereof in spaced relation to each other on a seafloor surface at a shallow depth to establish a targeted seawater zone within which certain conditions are detected, such as those produced by the presence of a sea vessel such as a submarine within the targeted zone. Data signals are generated within the deployed sensing modules in response to said detection of the submarine for radio frequency transmission above the seawater targeted zone from floating transmitters ejected from the sensing modules positioned on the seafloor surface after detection of the submarine.

3 Claims, 3 Drawing Sheets

UNDERWATER SURVEILLANCE SYSTEM

The present invention relates generally to surveillance and collection of data with respect to target zones within a body of seawater involving signal transmission of the data and collection thereof above the seawater surface.

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

Surveillance systems have been employed to detect hostile environments such as underwater zones in seawater that are targeted because of corrosion induced by sea vessels. Such systems utilize electronically enhanced magnetic and electric field sensing technologies involving microprocessors to obtain signal surveillance outputs reflecting detection, signature, classification, local positioning and tracking algorithms associated with targets, while discriminating against ambient noise and implanted or inserted countermeasures. Such prior surveillance systems involving long range acoustic and magnetic target detection are often unsuitable for targets such as small sea vessels in shallow water environments. It is therefore an important object of the present invention to provide for maximized acoustic, magnetic and electric field surveillance sensing to detect and report the location of sea vessel targets, such as submarines and surface ships, in selected target zones for different mission purposes.

SUMMARY OF THE INVENTION

Pursuant to the present invention, sensing modules are positioned underwater at preselected sea water locations to establish targeted surveillance zones within which magnetic and electric sensing fields are established for detection limited to targets such as relatively small submarines within shallow depth target zones. According to certain embodiments of the present invention, the sensing modules are initially deployed on seafloor surfaces at the bottom of preselected target zone locations. When a target is detected by one of the sensing modules, data transmitters are ejected therefrom and float to the top surface of the seawater to then transmit from a radio frequency radiation antenna data signals derived from the collected data within the sensing module from which the floating transmitter was ejected.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein.

DETIALED DESCRIPTION OF PREFERRED EMBODIMENT

Figure 1:
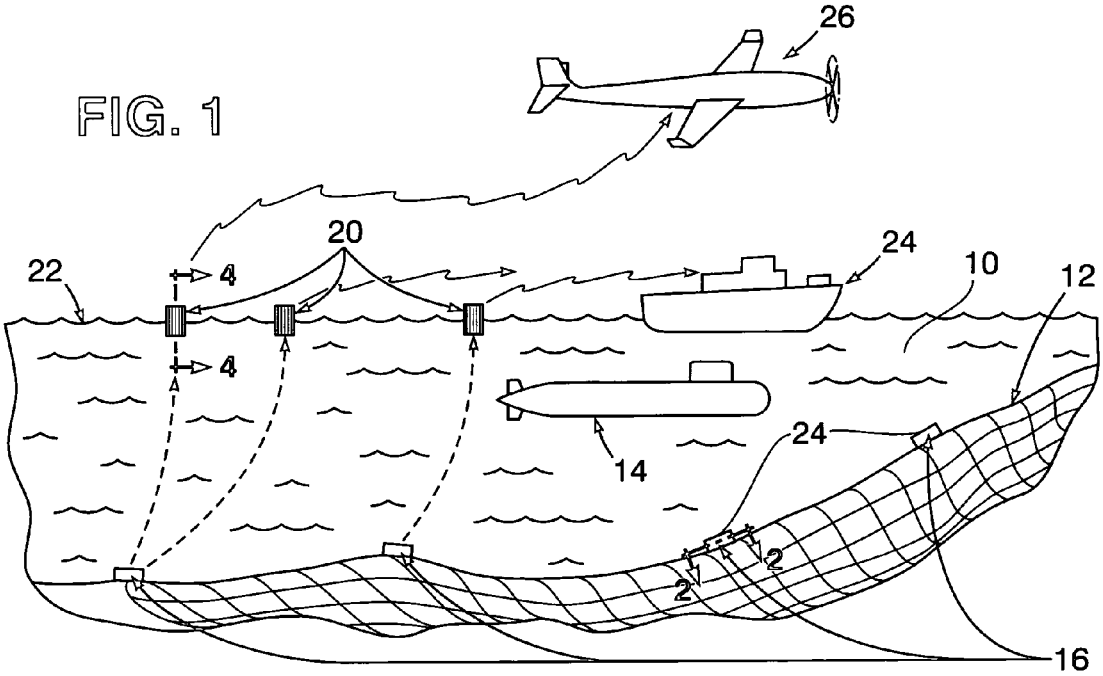
FIG. 1 is a side elevation view of an underwater targeted zone within a body of seawater undergoing surveillance pursuant to the present invention.

Referring now to the drawing in detail, FIG. 1 illustrates a body of seawater 10 having a shallow depth of less than 300 meters above a seafloor surface 12. A submarine target 14 is shown in the body of seawater 10 under surveillance within a target zone established by positioning of underwater sensor modules 16 in spaced relation to each other on the seafloor surface 12. Detection of the target 14 within such target zone is effected by means of a surveillance system associated with the aforesaid array of the underwater sensor modules 16 from which transmitters 20 are ejected and rise to floating level positions at seawater surface 22 as shown in FIG. 1. Once detection of the target 14 by one of the underwater sensor modules 16 has been effected, the transmitters 20 are ejected therefrom, as hereinafter explained, so as to float to the top seawater surface level 22 in response to data signals transmitted at radio frequencies from manned or unmanned data receiving vehicles, such as a surface ship 24 or an aircraft 26. The data signals, which originate as outputs from the sensor modules 16, reflect detection times and target location and characteristics. Such data signal outputs from the sensor modules 16 may also be collected within the ejected transmitters 20 floating on the seawater surface 22 for radio frequency transmission of the collected surveillance data to a receiver satellite. The number of the sensor modules 16 utilized will depend on the prescribed area of the target zone over the seafloor surface 12 and the surveillance mission scenario.

Figure 2:
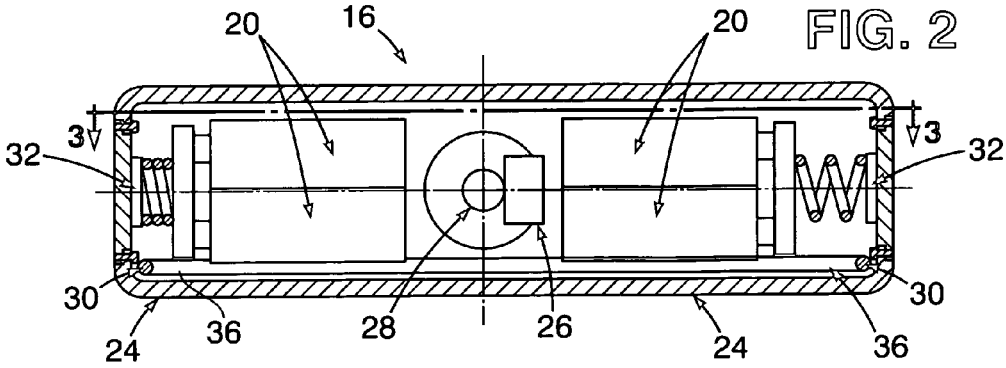
FIG. 2 is an enlarged section view of one of the sensing modules shown in FIG. 1, taken substantially through a plane indicated by section line 2—2.
Figure 3:
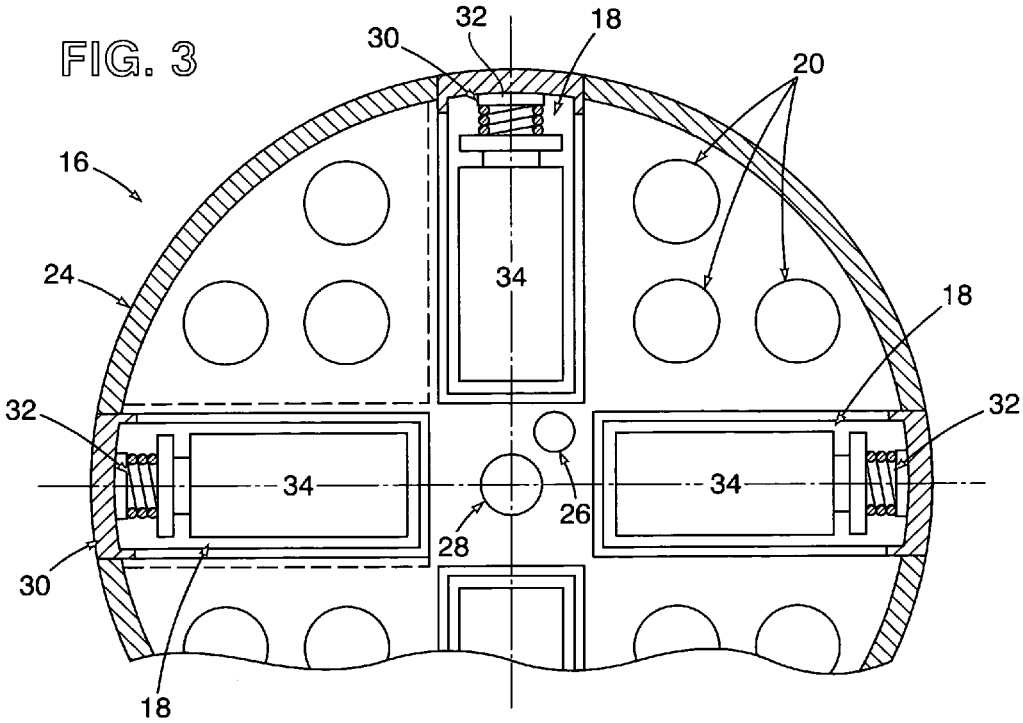
FIG. 3 is a partial section view taken substantially through a plane indicated by section line 3—3 in FIG. 2.

As shown in FIGS. 2 and 3, each of the sensor modules 16 has an outer cylindrical housing 24 within which a directional hydrophone 26 is fixedly mounted at a central location adjacent to a fixedly mounted low-power triaxial magnetometer 28. A plurality (such as twelve) of the transmitters 20 are positioned for ejection from the housing 24 of each of the sensor modules 16 at locations about the centrally located hydrophone 26 and magnetometer 28 therein. Also positioned within the housing 24 of the sensor module 16 are a plurality (such as four) electric field sensing electrode devices 18 to be ejected from openings in the housing 24 closed by releasable Nitinol closures 30. Associated with each of the electrode devices 18 is a spring biased electrode field sensor 32 having a "D" cell battery 34 for powering thereof. An inductive loop coil 36 is positioned on the base portion of the module housing 24 as shown in FIG. 2, to induce ejection of the electrode devices 18 from the housing 24 as hereinafter pointed out.

Figure 4:
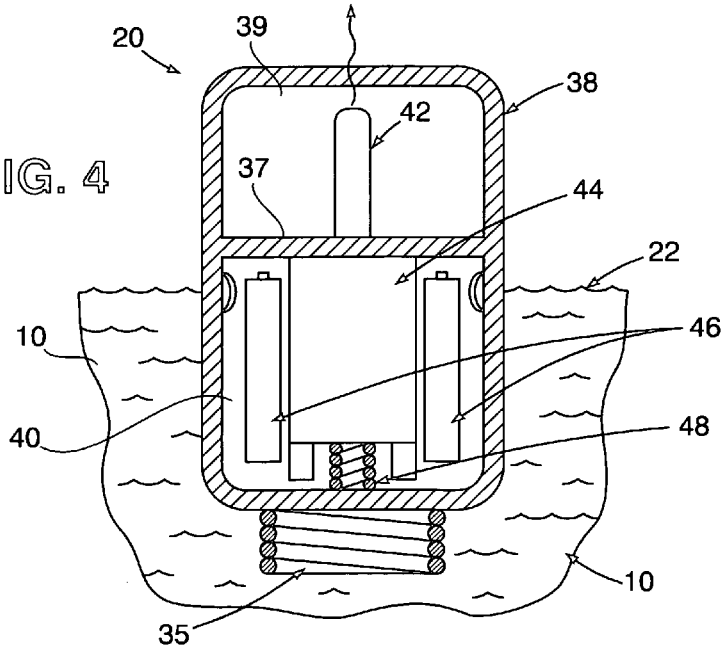
FIG. 4 is a section view of a data transmitter taken substantially through a plane indicated by section lien 4—4 in FIG. 1.

Alternatively, the transmitter 20 may be launched by ejection from the sensor module 16 upwardly through the seawater 10 to the floating position by the bias of a Nitinol spring 35 attached to the housing 38 as shown in FIG. 4.

Each of the ejected transmitters 20 shown floating in FIG. 4, has an outer float housing 38 internally divided by a partition 37 into an upper section 39 located above the seawater surface 22 and a lower section 40 therebelow. A radio frequency antenna 42 projects into the upper housing section 39 from electronics circuitry 44 therebelow within the lower housing section 40. AAA size batteries 46 and a local communications receiving bubble coil 48 are associated with the electronics circuitry 44 within the lower housing section 40.

Figure 5:
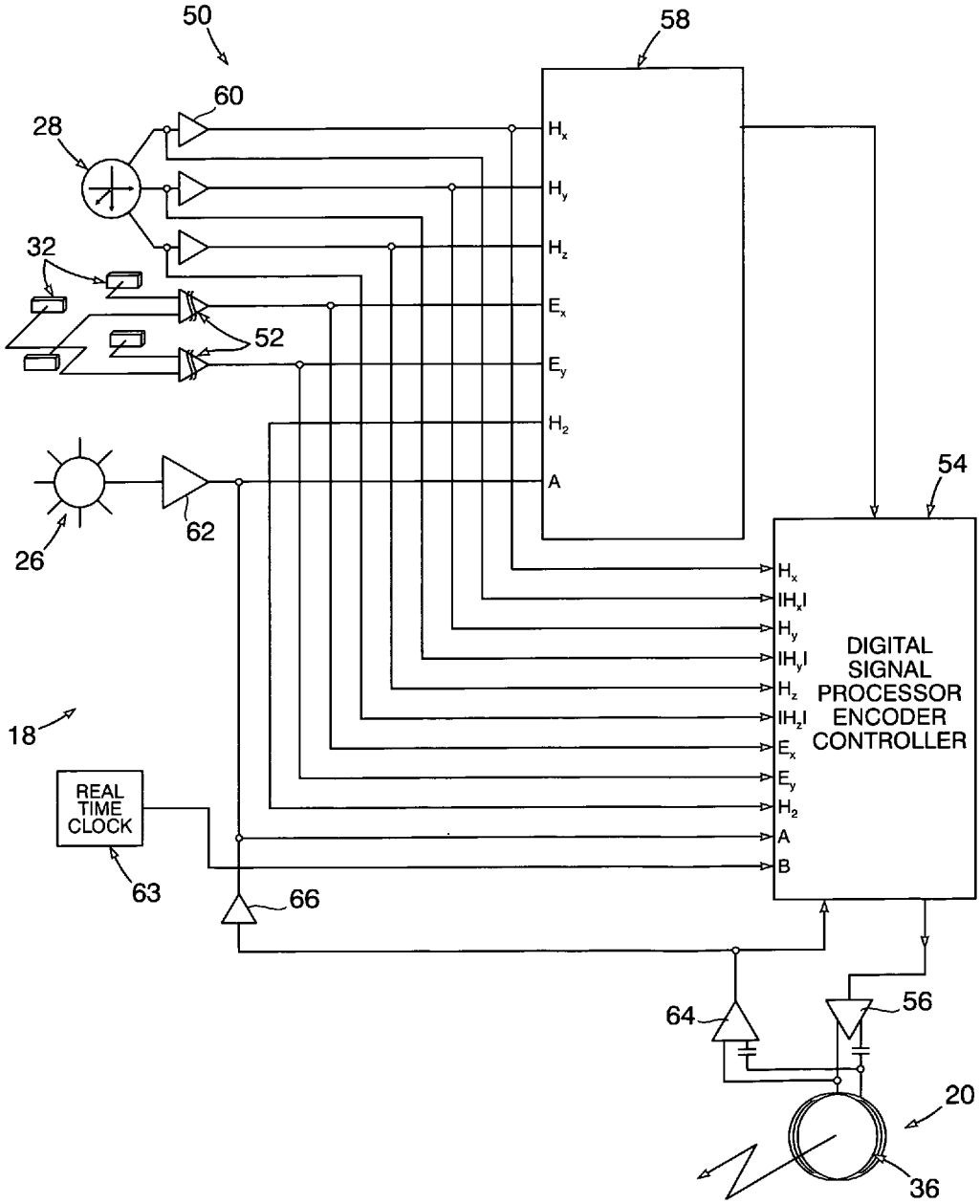
FIG. 5 is an electrical circuit diagram of the surveillance system embodied in each of the sensing modules depicted in FIGS. 1–3.

FIG. 5 diagrams a surveillance system 50 with which the previously referred to sensor modules 16 and associated transmitters 20 are associated, including the magnetometer 28, the hydrophone 26, the electric field sensors 32, the transmitter communications coil 36 and the bubble coils 48. As each of the sensor modules 16 drops through the seawater 10 toward the seafloor surface 12 during deployment, the system 50 is activated and the electric field sensors 32 are extended from the sensor housing 24. Analogue signal outputs from all of the field sensors 32 are then amplified and filtered by low-noise, low-power amplifier/filters 52 before entry as data inputs Ex and Ey into a digital controller 54 also diagrammed in FIG. 5, for signal processing and encoding thereof. Upon detection of the target 14 by the signal input sensors 32, data embodying all of its associated signature characteristics, such as positional location and detection time, are accordingly loaded into the electronics circuitry 44 of the transmitters 20 through the coil 36 by an output from the controller 54 amplified through an amplifier 56.

With continued reference to FIG. 5, the digital controller 54 of the system 50 has micro-power analog electronic circuitry to which amplified data signals are delivered from the electrode field sensors 32 of the sensor modules 16 through the amplifiers 52, while amplifiers 60 deliver amplified data signals from the magnetometers 28 of the sensor modules 16 to micro-power analog electronics 58 connected to the digital controller 54. Data signals, transmitted from the aircraft 26 for example, are amplified by an amplifier 62 and fed into the electronics 58, while data signal output of the digital controller 46 amplified by the amplifier 56 is fed to the loop coil 36 and respectively recycled through amplifiers 64 and 66 back into the digital controller 54 and to the electronics circuitry 58. The magnetometer 28 connected by the amplifiers 60 to the circuitry 58 applies data inputs (Hx), (Hy) and (Hz) thereto, while the hydrophone 26 connected through the amplifier 62 to the circuitry 58 and the controller 54 applies an acoustic input (A) thereto so as to provide well known operational capabilities. Also, a real time clock 63 provides a timing input (B) to the controller 54. The inputs to and from the loop coil 36 are also applied as amplified input (Hz) through the amplifier 66 to the circuitry of the controller 54.

Upon surfacing of one of the transmitters 20, after being physically ejected, then transmits to the surface ship 24, the signal data transferred thereto through the loop coil 36 from the controller 54 in one of the sensor modules 16, as hereinbefore described, is transmitted to a command center for fusing with data from the other of the sensor modules 16 to determine the factual situation to be dealt with.

Obviously, other modifications and variations of the present invention may be possible in light of the foregoing teachings. It is therefore to be understood that within the scope of the appended claims the invention may be practiced otherwise than as specifically described.

What is claimed is:

1. A system for surveillance of an underwater targeted zone within a body of seawater comprising: sensing means deployed into the body of seawater at a preselected location therein for location of said targeted zone from which conditions therein are detected and for generation of data signals reflecting detection of said conditions; and floating transmitter means for radio frequency transmission of said data signals from the sensing means deployed within the targeted zone, wherein said sensing means comprises: a plurality of electrode sensing modules deployed by positioning thereof in spaced relation to each other on a seafloor surface above which the targeted zone is established before said detection of the conditions therein; and means for ejection of the floating transmitter means from the sensing modules preceding said transmission of the data signals to be received above the body of seawater.

2. The system as defined in claim 1, wherein said conditions to be detected within the targeted zone arise from the presence of submerged vessels therein.

3. The system as defined in claim 2, wherein said targeted one has a shallow seawater depth above the seafloor surface of less than 300 meters.

* * * * *